United States Patent [19]

Duffy, Jr. et al.

[11] Patent Number: 4,861,056

[45] Date of Patent: Aug. 29, 1989

[54] FOLDING WHEELCHAIR WITH IMPROVED FRAME AND SUSPENSION SYSTEM

[75] Inventors: George Y. Duffy, Jr., Port Huron; Ted O. Flum, St. Clair, both of Mich.

[73] Assignee: Iron Horse Productions, Inc., Port Huron, Mich.

[21] Appl. No.: 119,730

[22] Filed: Nov. 12, 1987

[51] Int. Cl.[4] ..... A61G 5/02

[52] U.S. Cl. ..... 280/250.1; 280/42; 280/649; 297/DIG. 4

[58] Field of Search ..... 280/42, 242 WC, 289 WC, 280/701, 724, 725, 641, 647, 649; 297/DIG. 4

[56] References Cited

U.S. PATENT DOCUMENTS

| | | | |
|---|---|---|---|
| 2,462,711 | 2/1949 | Barnett | 280/277 |
| 2,669,289 | 2/1954 | Usher et al. | 280/42 |
| 4,078,817 | 3/1978 | Ferguson et al. | 280/242 WC |
| 4,190,263 | 2/1980 | Powers | 280/242 WC |
| 4,247,127 | 1/1981 | Wilkes | 280/242 WC |
| 4,310,167 | 1/1982 | McLaurin | 280/242 WC |
| 4,339,013 | 7/1982 | Weigt | 280/242 WC |
| 4,341,278 | 7/1982 | Meyer | 280/242 WC |
| 4,515,383 | 5/1985 | Minnebaker | 280/242 WC |

FOREIGN PATENT DOCUMENTS

| | | | |
|---|---|---|---|
| 1552260 | 9/1979 | Belgium | 280/242 WC |

OTHER PUBLICATIONS

"Safety and Handling" Everest & Jennings, "Wheelchair Prescription" Series, Booklet No. 3, 5M Rev. 6/82.

*Primary Examiner*—Charles A. Marmor
*Assistant Examiner*—Donn McGiehan
*Attorney, Agent, or Firm*—Harness, Dickey, Pierce

[57] ABSTRACT

A folding wheelchair with an improved frame and suspension system provides a smooth and cushioned ride over uneven terrain. The rigid frame of the wheelchair has a double "X" configuration of cross-tubes to improve frame strength without adversely affecting the foldability of the frame. The suspension system of the wheelchair comprises a pair of suspension wings pivotally mounted to the chair frame by a pivot block. The rearward end of the suspension wing is rotatably attached to the wheel axle. The frontward end of the wing engages a spring or shock absorber which, in turn, attaches to the chair frame. The independent suspension of the wheels and relatively long pivotal axis of the wing from the wheel axle provides for better maneuverability of the chair and for a more comfortable ride. Additional cushioning of the occupant during travel over uneven terrain is provided by the shock-cushioning mechanism of the spring or shock absorber.

18 Claims, 5 Drawing Sheets

FIG. 1.
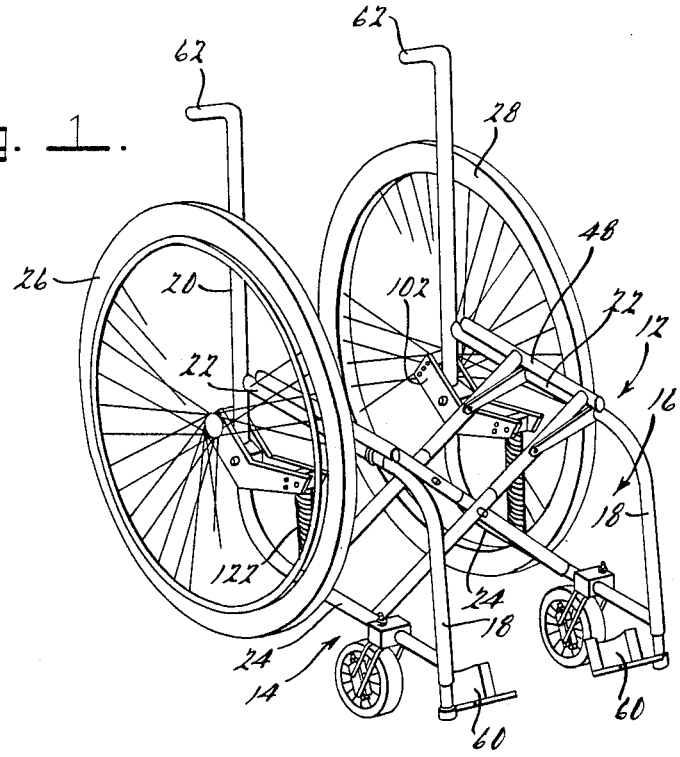
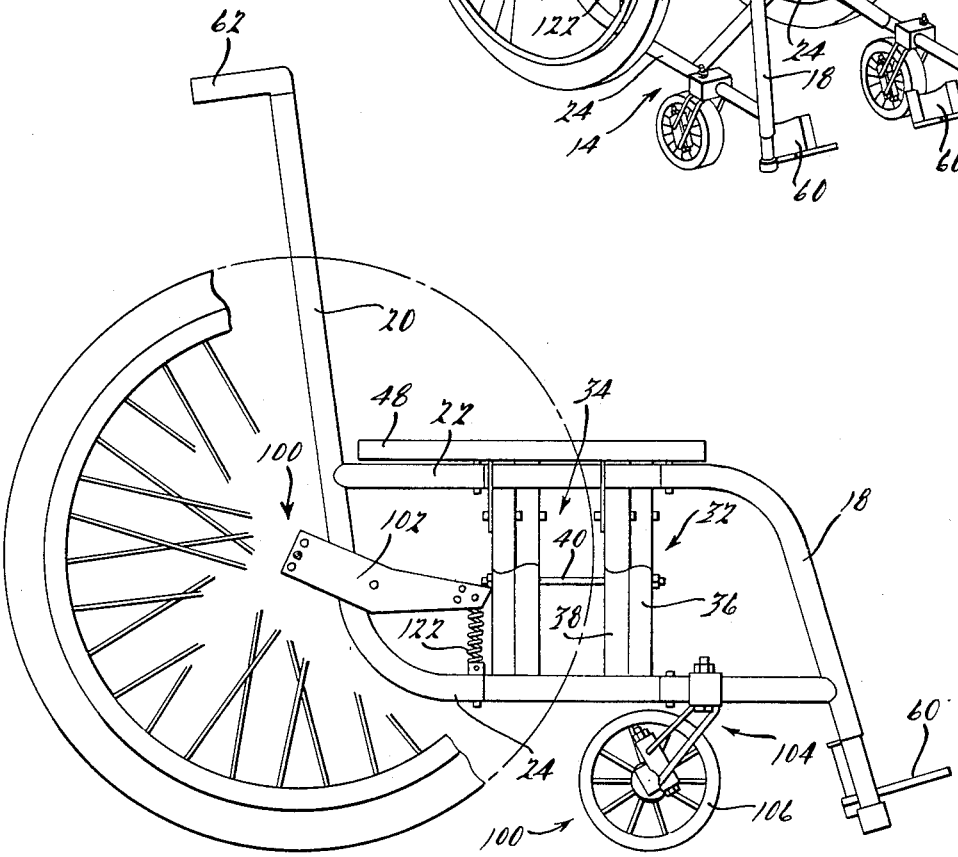
FIG. 2.

FOLDING WHEELCHAIR WITH IMPROVED FRAME AND SUSPENSION SYSTEM

BACKGROUND OF THE INVENTION

The present invention relates generally to wheelchairs, and more particularly, to an improved folding wheelchair with a novel suspension system.

Folding wheelchairs generally comprise a rigid frame with right and left closed frame members and a pair of large wheels rotatably mounted thereon by which the occupant can propel the chair. In foldable chairs, the right and left closed frame members are usually connected by two diagonally-extending cross-tubes which can be scissored together to fold the chair. However, although increasing portability, this type of folding frame arrangement sacrifices frame strength and stability.

Additionally, in conventional wheelchairs of either the folding or non-folding variety, the main wheels of the chair are generally mounted directly on the rigid frame. Thus any uneveness of the travelled terrain is conveyed to the occupant. Modifications of wheelchair designs to overcome this problem, such as the spring and/or shock-absorbing suspension systems described in U.S. Pat. No. 4,078,817, issued Mar. 14, 1978 to Furgeson, et al., and U.S. Pat. No. 4,190,263, issued Feb. 26, 1980 to Powers, have had varying degrees of success.

The present invention provides a wheelchair having a strong yet easily foldable frame and a novel suspension system which cushions the occupant and provides better maneuverability of the chair during travel over uneven terrain.

SUMMARY OF THE INVENTION

The present invention provides a wheelchair with an improved folding frame and a novel suspension system.

The improved frame of the chair of the invention has rigid right and left frame members attached to one another by two sets of cross-tubes in a "double-X" configuration. This configuration strengthens the frame yet allows it to be scissored together as easily as conventional folding chairs. The particular frame and cross-tube configuration of the chair of the present invention further provides a snap-lock feature which comes into play when the chair frame is fully expanded. The cross-tube frame can also be adjusted to vary the seat size to accommodate individual preferences.

The novel suspension system of the chair of the invention comprises a pair of pivoting suspension wings, one located on the inner side of each main wheel. One end of each wing is rotatably attached to the axle of its main wheel. The other end of the wing is connected to a horizontal frame member of the chair by a suspension spring, preferably a spring under tension, or a shock absorber. The pivot point of the suspension wing is provided by a pivot block located between the wing's axle and spring ends and mounted on a vertical member of the frame. The suspension system of the invention preferably further includes a caster wheel assembly, also having a spring under tension or shock absorber mounted thereto.

In operation, when one of the main wheels of the chair is forced upward of its position at rest, the suspension wing will pivot upward at its axle end, forcing the spring end of the suspension wing downward. The spring under tension then compresses and lessens the jolt conveyed to the occupant. Conversely, if the wheel experiences a downward motion, the axle end of the suspension wing will pivot downward. The spring end will, in turn, pivot upward and expand the spring to cushion the shock. Similarly, the springs of the caster wheel assembly will compress when the caster wheel is jolted upward and extend when the wheel is moved downward. Additionally, the suspension wing and caster assembly arrangement and the independent suspension of each wheel allow the chair to be easily maneuvered, particularly over uneven terrain or in negotiating curbs.

Thus, a wheelchair with a strengthened frame which can be easily folded and affords the occupant maximum comfort and maneuverability during travel is provided. These and further advantages of the improved wheelchair and suspension system will become apparent upon a reading of the detailed description of the preferred embodiment taken in conjunction with the accompanying drawings.

BRIEF DESCRIPTION OF THE DRAWINGS

FIG. 1 is a perspective view of a preferred embodiment of the wheelchair of the present invention.

FIG. 2 is a side view of the right closed frame member of the wheelchair of FIG. 1 with the right main wheel partially broken away.

DETAILED DESCRIPTION OF THE PREFERRED EMBODIMENT

Figure 3:
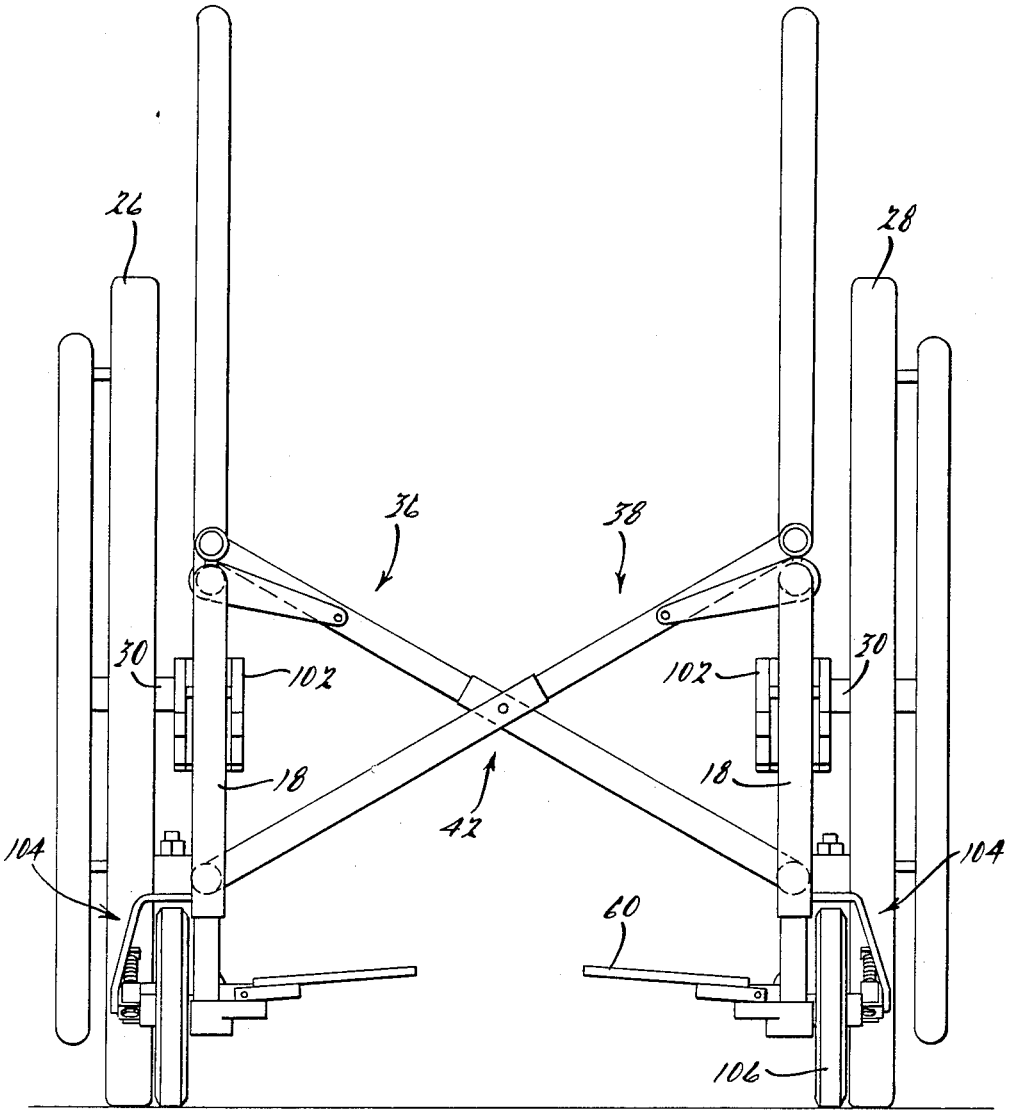
FIG. 3 is a front view of the wheelchair of FIG. 1.

Referring now to FIGS. 1 through 3, a preferred embodiment of the folding wheelchair of the present invention is shown and indicated generally by the numeral 10. The frame 12 of folding wheelchair 10 generally comprises right 14 and left 16 rigid closed frame members preferably constructed of metal tubing. Right and left closed frame members 14, 16 further comprise forward 18 and aft 20 substantially vertical frame members, and upper 22 and lower 24 substantially horizontal frame members. As particularly illustrated in FIG. 1, the right 26 and left 28 main wheels are rotatably mounted on their corresponding aft vertical frame members 20 by their respective wheel axles 30.

As shown in FIGS. 1 through 4, the right and left closed frame members of wheelchair frame 12 are connected to one another by two diagonally-extending sets of cross-tubes, front 32 and rear 34, which can be scissored together to fold the chair for storage or transport. As shown particularly in the exploded view of frame 12 in FIG. 4, each set of cross-tubes 32, 24 consists of two diagonally opposing cross-tubes 36, 38. The cross-tubes 36, 38 of each set are pivotally fastened to one another and to the second set by a cross-tube shaft 40 passing through cross-tube apertures 42 and secured at each end.

Referring again to FIG. 4, each cross-tube 36, 38 further comprises a telescopic arrangement of an inner 44 and outer 46 tube fastened together by cross-tube shaft 40 passing through cross-tube apertures 42 therethrough. With shaft 40 removed, inner 44 and outer tubes 46 can be telescoped to adjust the length of cross-tube 36, 38. The adjustment of cross-tube length, in turn, adjusts the seat width which is defined by the distance between the upper terminal portions of the cross-tube sets as described below. Inner 44 and outer 46 tubes are thus also preferably provided with a series of corresponding apertures (not shown) along their length to allow the passage of cross-tube shaft 40 therethrough when the inner and outer tubes are telescopically repositioned.

Figure 4:
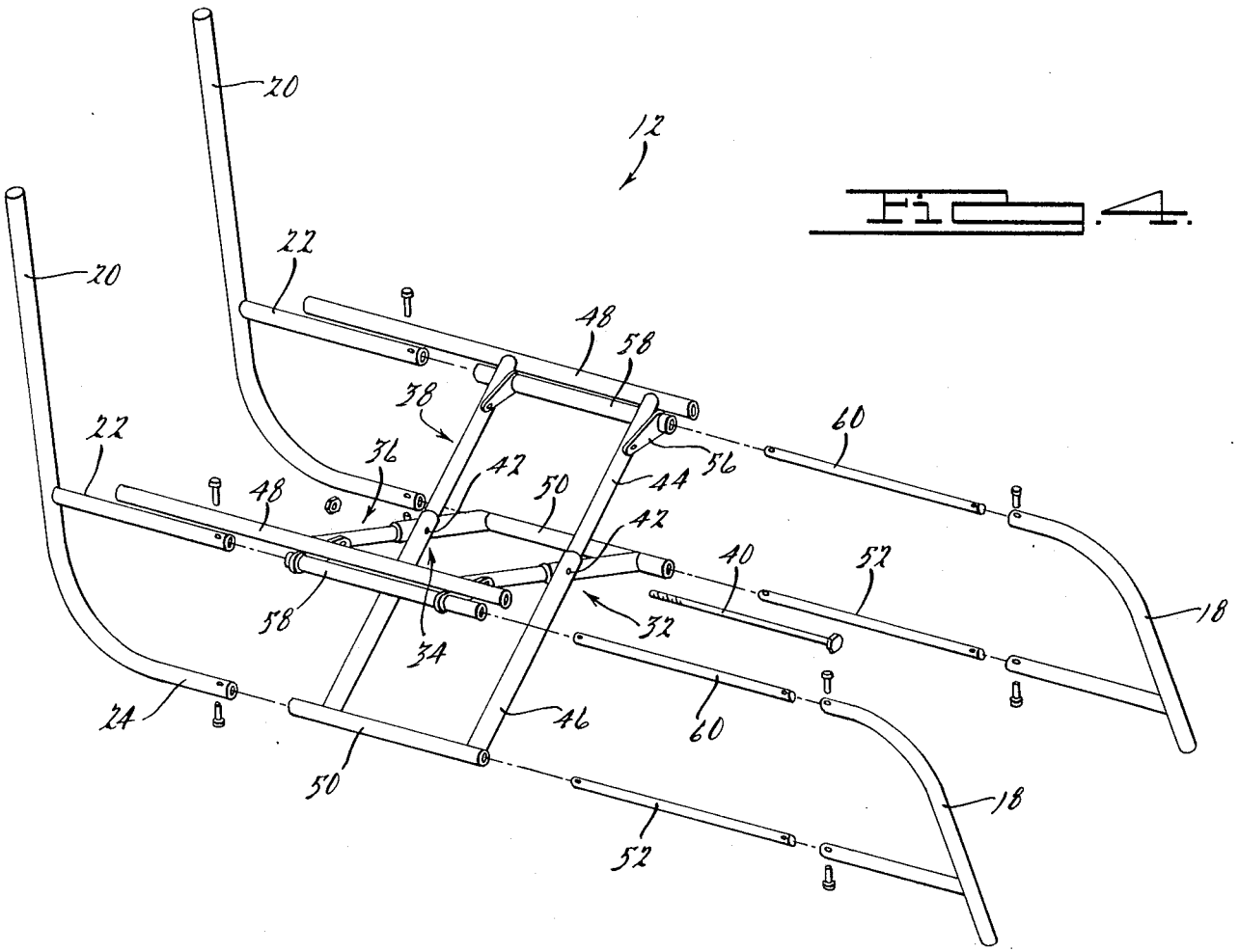
FIG. 4 is an exploded perspective view of a preferred embodiment of the frame of the present invention, particularly illustrating the "double-X" configuration of the frame.

As shown in FIG. 4, cross-tube sets 32, 34 of frame 12 are rigidly connected to one another at their terminal portions by upper 48 and lower 50 horizontal terminal members. Opposing upper terminal members 48 provide the seat portion of the chair frame where a seat or seat sling (not shown) can be attached. As noted above, the seat width can be varied by adjusting the length of the telescopically arranged cross-tubes and thus varying the distance between the right and left upper terminal members. A back sling or seat back (not shown) is also preferably attached to aft vertical members 22, 24 of the chair frame to provide full seating for the occupant.

Lower terminal members 50 of the cross-tube sets form a part of their respective lower horizontal frame members 24. Lower terminal member 50 is preferably attached to the rest of its lower horizontal frame member by a bushing 52 passing through the terminal member and bolted or otherwise secured at either end to the rest of lower horizontal frame member 24. This arrangement allows lower terminal member 50 to rotate with respect to the rest of its lower horizontal frame member 24, thus permitting the cross-tubes to be scissored together to fold the chair.

Each cross-tube set 32, 34 is also hingedly attached at the upper portions of its cross-tubes to upper horizontal frame members 22 by hinges 56 rigidly attached to a hinge tube 58. Similar to lower terminal member 50, hinge tube 58 forms a portion of upper horizontal frame member 22 and is rotatably attached to the rest of upper horizontal member 22 by a bushing 60 passing through hinge tube 58 and bolted or otherwise secured at either end to the rest of upper horizontal frame member 22.

As shown in FIGS. 1 through 3, the frame of the chair of the present invention further preferably includes a set of footrests 60, one attached to the terminal portion of each forward vertical member 18, and a set of hand bars 62, one on the terminal portion of each aft vertical member 20. The wheelchair also preferably includes arm rests (not shown) pivotally mounted on the aft vertical frame members.

Due to the arrangement of the "double X" frame and cross-tubes of the present invention, when the wheelchair of the invention is expanded from a folded position, a modicum of resistance is encountered just prior to full expansion of the chair frame. When the chair frame is expanded past the point of resistance to a fully open position, the chair frame snap-locks into position to provide a strong and secure frame.

Referring now to FIGS. 1 through 3, the wheelchair of the present invention further includes an improved suspension system, denoted generally by the numeral 100, which cushions the occupant during travel over uneven terrain and provides for better maneuverability of the chair. Suspension system 100 generally comprises a pivoting suspension wing 102 disposed on the inside of each main wheel 26, 28 and an improved caster wheel assembly 104 for each caster wheel 106, both wing and assembly having a spring or other shock-cushioning means attached thereto.

Figure 5:
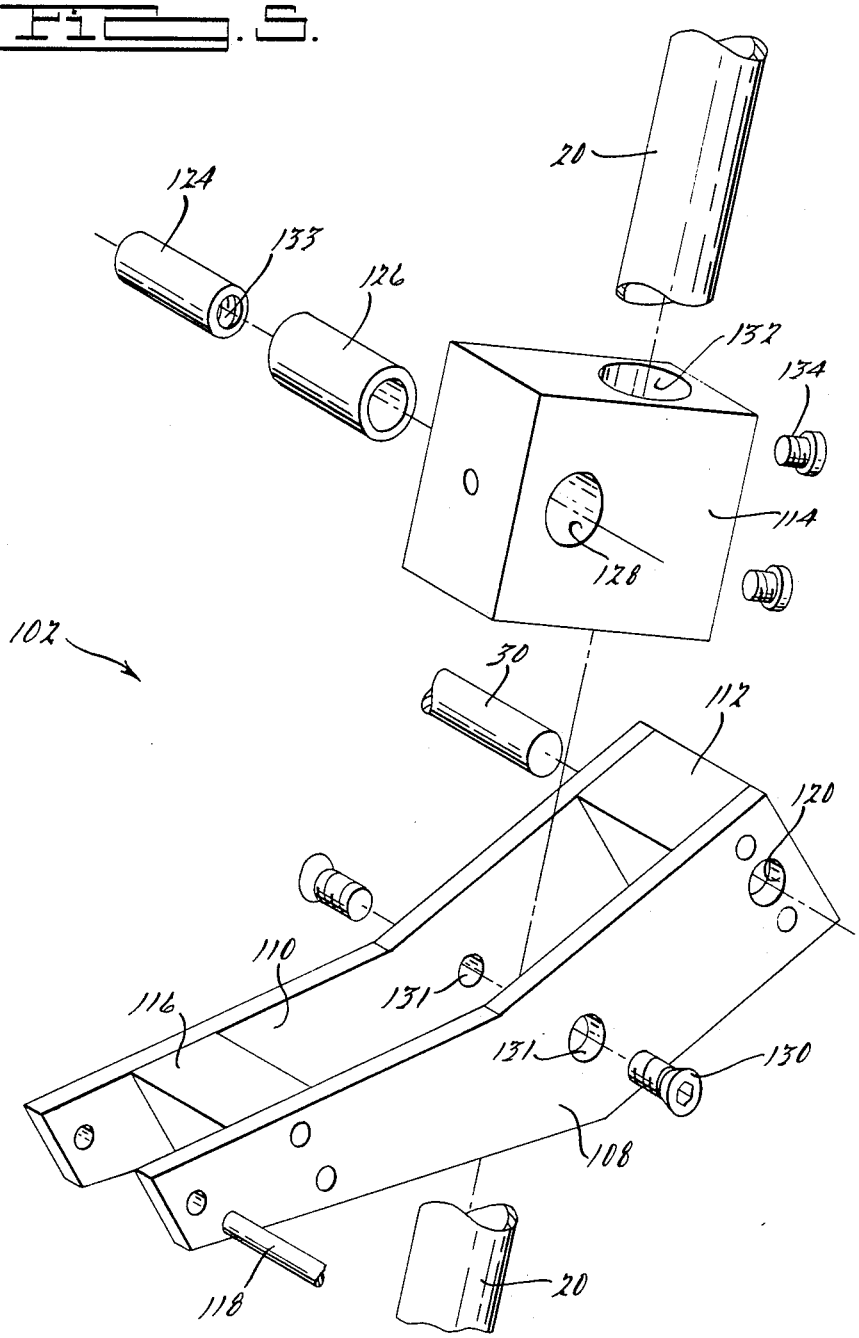
FIG. 5 is an exploded perspective view of a preferred embodiment of the suspension wing of the suspension system of the present invention.

As shown particularly in the exploded view of FIG. 5, suspension wing 102 comprises two substantially planar wing members 108, 110 with an axle block 112, pivot block 114, spring block 116 and spring pin 118 disposed therebetween. Planar wing members 108, 110 preferably have a roughly wide V-shaped configuration, which, when suspension wing 102 is in place on the chair, have the point of the "V" pointing groundward. It should be appreciated, however, that the suspension wing may also be positioned with the point of the "V" facing upward.

When in place on the wheelchair, one end of suspension wing 102 is rotatably mounted on wheel axle 30 which passes through an axle block aperture 120 in the wing's axle block 112 and is secured thereto. The opposite or spring end of suspension wing 102 is attached to a first end of a spring 122 (shown in FIGS. 1 and 2), preferably compression spring, by means of spring pin 118 disposed at the spring block end of the wing. Spring 122 in turn attaches to lower horizontal member 24 of the frame at the spring's second end. Spring block 116 of suspension wing 102 is provided to strengthen and stabilize the wing at its spring end and during operation.

Although it is preferred that spring 122 be attached to spring pin 118, it should be appreciated that spring 122 may instead by directly attached to spring block 116. It should further be appreciated that the second end of spring 122 may be attached to a frame member other than lower horizontal frame member 24, such as upper horizontal frame member 22. Moreover, although the shock-cushioning mechanism herein described in a suspension spring, any other suitable mechanism, such as a compression spring or shock absorber, may be provided in its stead.

Referring again to FIGS. 1 and 5, the pivot point of suspension wing 102 is provided by pivot block 114 disposed between the wing's axle and spring ends. As shown more particularly in FIG. 5, pivot block 114 is secured between planar wing members 108, 110 by a pivot tube 124 encased by a bushing 126 which passes through a pivot tube aperture 128 in pivot block 114. Each end of pivot tube 124 is further secured to wing 102, preferably by a set of screws 130 passing through apertures 131 in planar wing members 108, which can engage the threaded interior (as shown at 133) of pivot tube 124. A series of apertures through planar wing members 108 may also be provided to allow pivot block 114 to be repositioned closer to either the wing's axle or spring end in order to adjust the precise pivot point of suspension wing 102.

Figure 6:
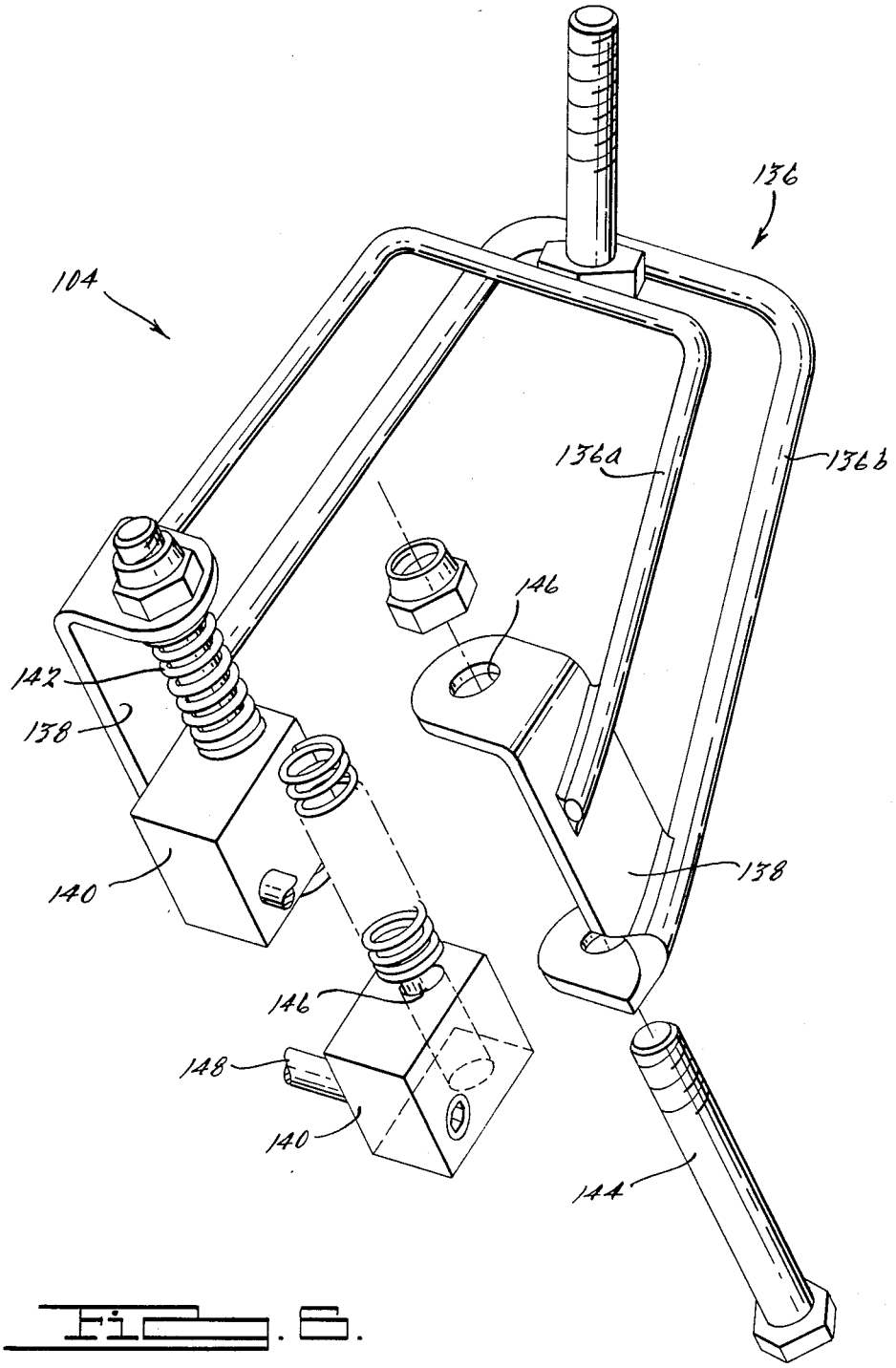
FIG. 6 is an exploded perspective view of a preferred embodiment of the caster wheel assembly of the wheelchair of the present invention.

Pivot block 114 further provides a point of attachment for suspension wing 102 to chair frame 12. Referring again to FIG. 5, pivot block 114 contains a frame member aperture 132 through which aft vertical frame member 20 passes, thereby mounting pivot block 114 and suspension wing 102 to the chair frame. Pivot block 114 is secured to vertical frame member 20, preferably by a set of screws 134 passing through corresponding apertures (not shown) in pivot block and vertical frame members. Although in FIG. 5 pivot block 114 is shown having a one-piece unitary construction, it should be understood that pivot block 114 may be actually manufactured in two or more pieces which are bolted, welded or otherwise secured together. Suspension system 100 of the present invention preferably further comprises a caster wheel assembly 104, as depicted in FIG. 6, mounted to lower horizontal frame members 24. Caster wheel assembly 104 generally comprises a stirrup 136, preferably comprising two stirrup members 136*a* and 136*b* constructed of metal, and U-shaped block mounts 138 attached to the stirrup's 136 terminal portions. A spring block 140 and a spring under tension 144 adjacent thereto are secured between the arms of each U-shaped block mount 138, preferably by a bolt 144 passing through corresponding apertures 146 in block mount 138 and spring block 140 and through the center of the spring. It should again be appreciated that, although a compression spring is depicted in FIG. 6, any other shock-cushioning means such as a under spring tension or shock absorber may be employed. Caster wheel (not shown in FIG. 6) is rotatably mounted to caster wheel assembly 104 by a caster wheel axle 148 extending between the caster spring blocks 140 and secured thereto.

In operation, when main wheel 26, 28 of the chair of the present invention is jolted upward by an unevenness in the terrain, the wheel will be forced upward of its normal position. Suspension wing 102 will then pivot upward at its axle block end, forcing the spring end of the wing downward and compressing spring 122 to lessen the jolt conveyed to the occupant. Conversely, if the wheel experiences a downward motion due to its encounter with a depression in the terrain, the axle end of suspension wing 102 will pivot downward and the spring end of the wing will, in turn, pivot upward and expand the spring to lessen the shock. Similarly, spring 144 of caster wheel assembly 104 will compress when caster wheel 106 is jolted upward, and extend when the caster wheel is moved downward.

Additionally, the functional arrangement of suspension system 100 provides better maneuverability of the chair over uneven terrain. More specifically, the suspension wing's relatively long pivotal axis from the wheel axle and the independent suspension of all the wheels allow the wheels of the chair to be maneuvered separately and more easily, particularly, for example, when negotiating curbs. Thus, the wheelchair of the present invention provides the occupant with a sturdy foldable chair with greater comfort and maneuverability than conventional chairs.

It will be appreciated that the above disclosed embodiment is well calculated to achieve the aforementioned objectives of the present invention. In addition, it is evident that those skilled in the art, once given the benefit of the foregoing disclosure may now make modifications of the specific embodiment described herein without departing from the spirit of the present invention. Such modifications are to be considered within the scope of the present invention, which is solely limited by the scope and spirit of the appended claims.

What is claimed is:

1. A folding wheelchair comprising a rigid frame and main wheels rotatably mounted on said frame by wheel axles, said wheelchair further comprising:

left and right opposing closed frame members, each having a plurality of substantially horizontal and vertical frame members, said horizontal members including an upper and lower horizontal frame member and said vertical members including a forward and aft vertical frame member;

a plurality of sets of cross-tubes, each set of said cross-tubes including a right and left diagonally-extending cross-tube, each of said cross-tubes having an upper and lower portion wherein said upper portion of each of said cross-tubes is movably attached to one of said upper horizontal frame members and said lower portion of each of said cross-tubes is movably attached to an opposing lower horizontal frame member, said sets of cross-tubes having pivot means for scissoring said sets together to fold said frame, a hinge tube rotationally engaging each upper horizontal frame member and hingedly coupled with each cross-tube for enhancing said scissoring; and a seat portion connected to at least two of said cross-tubes.

2. The wheelchair of claim 1, wherein said seat portion further includes an upper horizontal terminal member rigidly connected to the upper portion of one of said cross-tubes of each of said sets.

3. The wheelchair of claim 1, wherein each of said cross-tubes further comprises an inner and outer tube in telescopic arrangement for varying the length of said cross-tube.

4. The wheelchair of claim 1, further comprising a suspension system, said system including a suspension wing having an axle end and a shock-cushioning end remote from said axle end, wherein a wheel is rotatably mounted on said axle at said axle end of said wing; and said system further including shock-cushioning means attached to said shock-cushioning end of said wing, wherein said shock-cushioning means is further attached to said frame, and wherein said wing is pivotally mounted between its axle and shock-cushioning ends to said frame of said wheelchair.

5. The wheelchair of claim 4, wherein said suspension wing further comprises two substantially planar wing members having a pivot block disposed therebetween to pivotally mount said wing on said frame.

6. The wheelchair of claim 5, wherein said suspension wing further comprises an axle block having an axle aperture, said axle block being disposed between said planar wing members at said axle end of said suspension wing, wherein said axle of said main wheel passes through said axle aperture to rotatably mount said wheel to said wing.

7. The wheelchair of claim 5, wherein said shock-cushioning means comprises a spring with first and second ends and said suspension wing further comprises a spring block and spring pin disposed between said planar wing members at said shock-cushioning end of said wing, wherein said first end of said spring is attached to said spring pin and said second end of said spring is attached to said frame.

8. The wheelchair of claim 7, wherein said second end of said spring is attached to a lower horizontal member of said closed frame member.

9. The wheelchair of claim 4, wherein said suspension system further comprises a caster wheel assembly having a caster wheel rotatably mounted thereto, wherein said assembly is mounted to said frame of said wheelchair, said assembly including shock-cushioning means mounted thereto.

10. An improved suspension system for a wheelchair having a rigid frame and main wheels rotatably mounted to said frame by wheel axles, comprising:

a suspension wing having an axle end and a spring end, wherein said wing is pivotally mounted between its axle and spring ends to said rigid frame of said wheelchair, wherein said suspension wing further comprises two substantially parallel planar wing members, spacer block means for joining said wing members together at their ends, and a pivot block disposed between said planar wing members to pivotally mount said suspension wing to said frame.

11. The suspension system of claim 10, wherein said suspension wing further comprises spring attachment means disposed at said spring end of said suspension wing and further includes shock-cushioning means having a first end attached to said spring attachment means and having a second end attached to said frame of said wheelchair.

12. The suspension system of claim 11, wherein said suspension wing further includes an axle block having an axle aperture, said axle block being disposed between said planar wing members at said axle end of said wing, wherein an axle of said main wheel passes through said axle aperture to rotatably mount said wheel to said wing.

13. The suspension system of claim 11, wherein said shockcushioning means comprises a spring having first and second spring ends and said spring attachment means comprises a spring block and spring pin disposed between said planar wing members of said spring end of said suspension wing, wherein said first spring end is attached to said spring pin and said second spring end is attached to said frame.

14. The suspension system of claim 13, wherein said suspension system further comprises a caster wheel assembly having a caster wheel mounted thereto, wherein said assembly is mounted to said frame of said wheelchair, said assembly including shock-cushioning means mounted thereto.

15. The suspension system of claim 13, wherein said frame of said wheelchair further comprises left and right opposing closed frame members, each having a plurality of substantially horizontal and vertical frame members, said horizontal members including an upper and lower horizontal member and said vertical members including a forward and aft vertical member, wherein said pivot block is mounted on an aft vertical member of said frame of said wheelchair and said second spring end of said spring is attached to a lower horizontal member of said closed frame member.

16. The suspension system of claim 15, wherein said frame of said wheelchair further comprises a plurality of sets of cross-tubes, including two opposing diagonally-extending cross-tubes having apertures therethrough, each of said cross-tubes having an upper and lower portion, wherein each of said cross-tubes further comprises an inner and outer tube in telescopic arrangement, and wherein the upper portion of each of said cross-tubes is movably attached to an upper horizontal frame member and the lower end is movably attached to an opposing lower horizontal frame member, said cross-tubes further having a pivot shaft passing through said apertures in said cross-tubes and secured thereto, and said cross-tubes further including upper horizontal terminal members for attaching a set to said frame.

17. A folding wheelchair comprising a rigid frame and main wheels rotatably mounted to said frame by wheel axles, said wheelchair further comprising:

left and right opposing closed frame members, each having a plurality of substantially horizontal and vertical frame members, said horizontal members including an upper and lower horizontal frame member and said vertical members including a forward and aft vertical frame member;

a plurality of sets of cross-tubes, each set of said cross-tubes including two opposing diagonally-extending cross-tubes having apertures therethrough, each of said cross-tubes having an upper and lower portion, wherein each of said cross-tubes further comprises an inner and outer tube in telescopic arrangement, and wherein the upper portion of each of said cross-tubes is movably attached to an upper horizontal frame member and the lower end is movably attached to an opposing lower horizontal frame member, said cross-tubes further having a pivot shaft passing through said apertures in said cross-tubes and secured thereto, said cross-tubes further including upper horizontal terminal members for attaching a seat to said frame; and a suspension system comprising a suspension wing comprised of two substantially parallel planar wing members each having an axle end and a shock-cushioning end remote from said axle end, wherein said wing members are rotatably mounted on said wheel axle at said axle end, said system further including shock-cushioning means attached to said shock-cushioning end of said wing members, wherein said shock-cushioning means is further attached to said frame, and wherein said suspension wing further includes spacer block means for joining said wing members together at their ends, and a pivot block disposed between its axle and shock-cushioning ends to pivotally mount said wing on said frame.

18. A folding wheelchair comprising a rigid frame and main wheels rotatably mounted on said frame by wheel axles, said wheelchair further comprising:

left and right opposing closed frame members, each having a plurality of substantially horizontal and vertical frame members, said horizontal members including an upper and lower horizontal frame member and said vertical members including a forward and aft vertical frame member; and a plurality of sets of cross-tubes, each set of said cross-tubes including a right and left diagonally-extending cross-tube, each of said cross-tubes having an upper and lower portion wherein said upper portion of each of said cross-tubes is movably attached to one of said upper horizontal frame members and said lower portion of each of said cross-tubes is movably attached to an opposing lower horizontal frame member, said sets of cross-tubes having pivot means for scissoring said sets together to fold said frame, a hinge tube rotationally engaging each upper horizontal frame member and hingedly coupled with each cross-tube for enhancing said scissoring, wherein each of said cross-tubes further comprises an inner and outer tube in telescopic arrangement for varying the length of said cross-tube.

* * * * *

UNITED STATES PATENT AND TRADEMARK OFFICE

CERTIFICATE OF CORRECTION

PATENT NO. : 4,861,056

DATED : August 29, 1989

INVENTOR(S) : George Y. Duffy, Jr. et al.

It is certified that error appears in the above-identified patent and that said Letters Patent is hereby corrected as shown below:

Col. 2, Line 63, "24" should be --34--;

Col. 4, Line 24, insert "a" after --preferably--;

Col. 4, Line 32, "by" should be --be--;

Col. 4, Line 37, "in" should be --is--;

Col. 5, Line 17-18, "under spring tension" should be --spring under tension--;

Col. 7, Line 26, Claim 13, "shockcushioning" should be --shock-cushioning--;

Signed and Sealed this

Second Day of October, 1990

*Attest:*

HARRY F. MANBECK, JR.

*Attesting Officer*

*Commissioner of Patents and Trademarks*